US006802145B2

(12) United States Patent
Sparkowski

(10) Patent No.: US 6,802,145 B2
(45) Date of Patent: Oct. 12, 2004

(54) HANGING SIGN ASSEMBLY

(75) Inventor: Robert P. Sparkowski, Schaumburg, IL (US)

(73) Assignee: Chicago Display Marketing, Melrose Park, IL (US)

( * ) Notice: Subject to any disclaimer, the term of this patent is extended or adjusted under 35 U.S.C. 154(b) by 0 days.

(21) Appl. No.: 10/305,314

(22) Filed: Nov. 26, 2002

(65) Prior Publication Data

US 2004/0098895 A1 May 27, 2004

(51) Int. Cl.[7] ..... G09F 7/22
(52) U.S. Cl. ..... 40/617; 40/606.18; 40/611.01
(58) Field of Search ..... 40/617, 606.01, 40/606.18, 611.01, 745

(56) References Cited

U.S. PATENT DOCUMENTS 3,707,053 A * 12/1972 Itano ..... 40/781
3,979,846 A 9/1976 Euzarraga
4,105,127 A 8/1978 Holl
4,187,630 A * 2/1980 Giulie et al. ..... 40/790
4,391,375 A 7/1983 Joyce
4,564,165 A 1/1986 Grant et al.
4,629,075 A 12/1986 Hutten
4,882,864 A * 11/1989 Selwyn-Smith ..... 40/617
4,882,866 A * 11/1989 Gebhardt ..... 40/611.01
5,381,991 A 1/1995 Stocker
5,863,019 A 1/1999 Rose et al.
5,992,813 A 11/1999 Keers
6,088,942 A 7/2000 Brooks et al.
6,296,219 B1 10/2001 Kobele
2002/0184806 A1 * 12/2002 Cyrluk ..... 40/617

* cited by examiner

*Primary Examiner*—Gary C. Hoge
(74) *Attorney, Agent, or Firm*—Vedder Price Kaufman & Kammholz

(57) ABSTRACT

A display assembly includes a panel for displaying indicia having opposed ends operatively connected to first and second channels. The panel has score lines adjacent each opposed end to define opposed flaps. The first and second channels each have a flange extending from one wall to adjacent opposed wall to define the elongated opening into the channel. A device supports the assembly from a support and a safety device loosely extends from a first channel to the second channel. Each flap is moved about the score line for insertion through the elongated opening such that when the flap is inserted beyond the free end of the flange, the flap is biased way from the panel to connect the panel to the channel.

18 Claims, 3 Drawing Sheets

FIG. 2

HANGING SIGN ASSEMBLY

BACKGROUND OF THE INVENTION

The present invention relates generally to an advertising display system, and more particularly, to a hanging sign system for displaying advertising indicia which is suspended from a ceiling or a wall.

Prior art sign systems often include complex assemblies to attach the sign or support the sign in a display orientation. For example, U.S. Pat. No. 4,564,165 issued to Grant et al., describes an assembly for connecting a sign support to a suspended ceiling construction. One disadvantage of this design is that one element attaches to the ceiling support and another attaches to the first element for then supporting the sign. Another disadvantage is that the sign must be mounted essentially flush with the ceiling. Thus, stores with high ceilings must use much larger signs than required. Accordingly, changing signs is increasingly difficult and complex. Further, another disadvantage is that there is no safety device which would prevent the sign from falling in the event of a failure of the support. Moreover, this display system is only useful in connection with suspended ceiling construction. Other styles of ceilings or alternative mounting locations are unavailable for this design. Disadvantages of other prior art display systems include, sign roll-up at the bottom of the sign and complex attachment/stretching devices.

Therefore, there is a need in the art for a hanging sign system which is simple to assemble, includes a minimal number of parts, stretches the display sign, prevents roll-up, includes a safety device and may be disposed in any position at any height whether by hanging from the ceiling or from a wall.

BRIEF DESCRIPTION OF THE DRAWINGS

In the course the following detailed description, reference will be made to the attached drawings wherein like reference numerals identify like parts and in which.

DETAILED DESCRIPTION OF A PREFERRED EMBODIMENT

One principle aspect of the present invention is directed to a display assembly including a panel for displaying indicia having opposed ends, where each opposed end is operatively connected to one of a first and a second channels. The panel further has a score line formed therein adjacent each opposed end to thereby define opposed flaps. The first and second channels each include an elongated base, first and second opposed walls extending from offset edges of the elongated base and a flange extending from a free end of one of the first and second walls in the direction of the other wall and the elongated base such that a free end of the flange is disposed proximate the other wall in order to define an elongated opening into the channel. A device has proximate end connected to the first channel and a distal end connected to a support such that the assembly depends from the support. A safety device loosely extends from the first channel to the second channel. Each opposed flap is moved about the score line to a position oriented approximately parallel with the panel for insertion through the elongated opening in one of the first and second channel such that when the free end of the flap is inserted beyond the free end of the flange, the flap is biased away from approximate parallel orientation of the panel and thereby connects the panel to the channel.

In another principal aspect of the present invention, a display assembly includes a first channel and a second channel disposed in a first operative position where each first and second channels is operatively connected to a panel for displaying indicia thereon. The first and second channels each include an elongated base, first and second opposed walls extending from offset edges of the elongated base and a flange extending from a free end of one of the first and second walls in the direction of the other wall and the elongated base, such that a free end of the flange is disposed proximate the other wall in order to define an elongated opening into the channel. The panel includes opposed ends and a score line formed therein adjacent each of the opposed ends to define opposed flaps which are moved about respective score lines in order to pass through the elongated opening to operatively connect the panel to the first and second channels. A device has a proximate end connected to the first channel and a distal end connected to a support such that the assembly depends from the support. A safety device loosely extends from the first channel to the second channel when the first and second channel are disposed in the first operative position. A second operative position is defined when the first or second channel is disconnected from the panel such that the safety device taughtly extends between the first and second channels in order to support the second channel.

Figure 1:
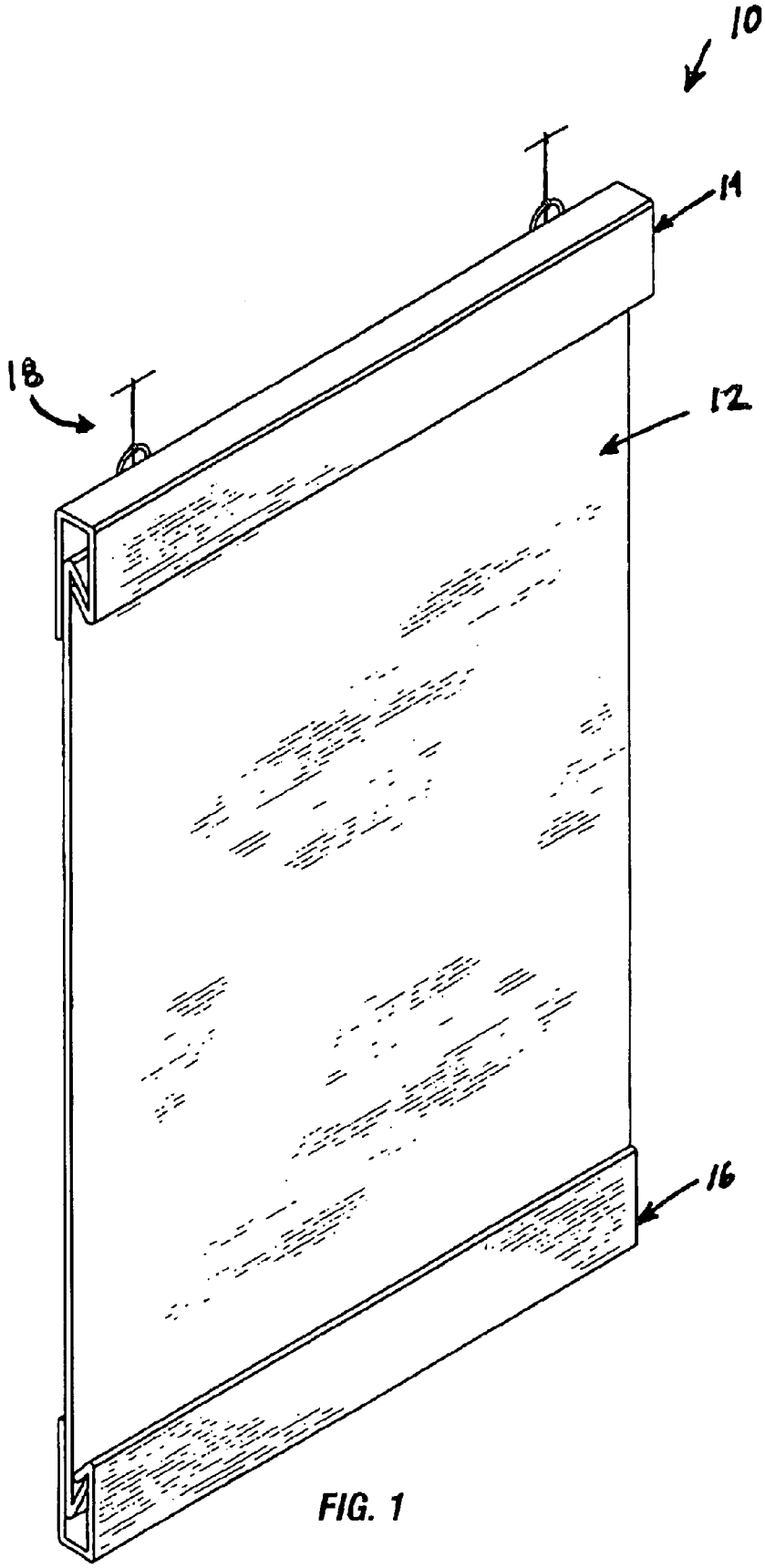
FIG. 1 is a perspective view of the hanging sign display assembly in accordance with the principles of the present invention.
Figure 2:
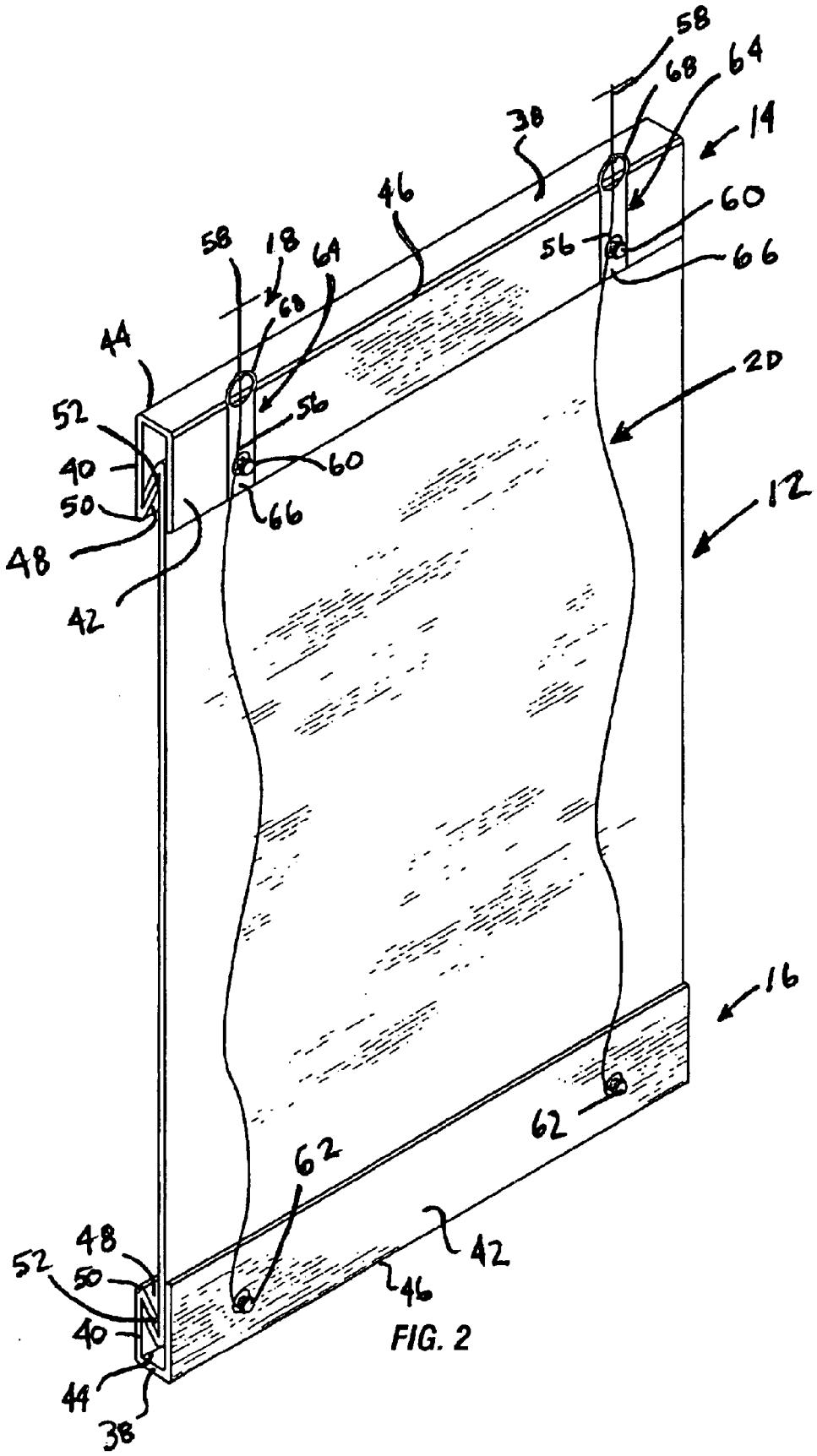
FIG. 2 is a rear perspective view of the hanging sign display assembly of FIG. 1 illustrating the safety device.

Generally, the display assembly 10 of the present invention shown in FIGS. 1–6 includes a panel 12 for displaying advertising indicia (not shown), a first channel 14, a second channel 16, a device 18 for supporting the display assembly 10, and a safety device (20, as shown in FIG. 2).

Figure 3:
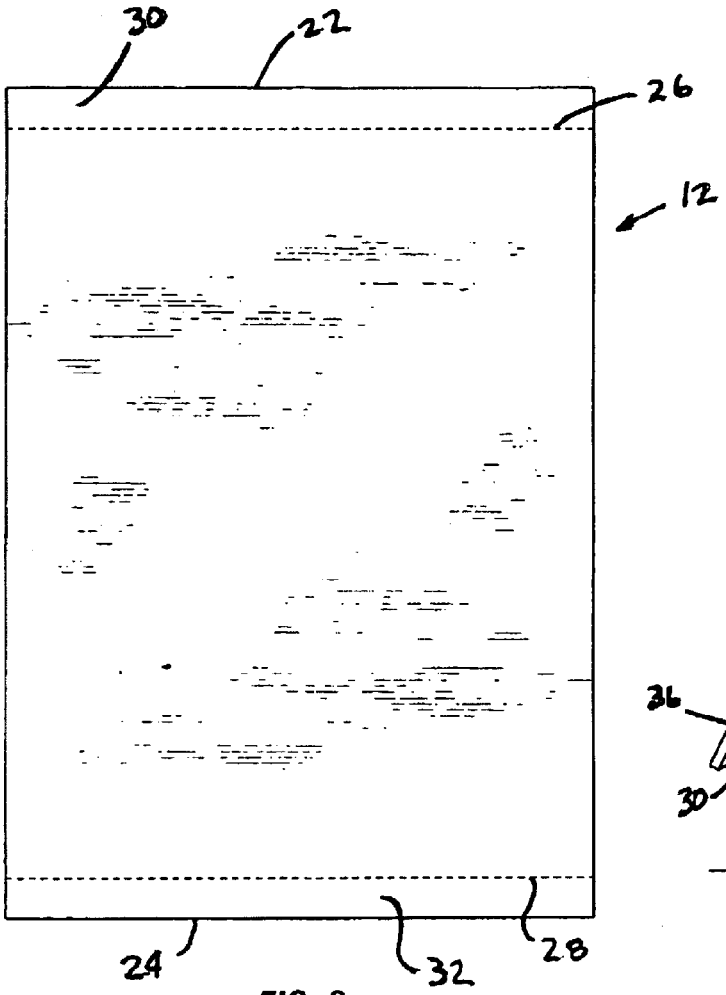
FIG. 3 is a top plane view of the panel used in the hanging sign display assembly of FIG. 1.

Referring to FIG. 3, the panel 12 has opposed ends 22, 24 which are each operatively connected to one of the first and second channels. The panel 12 also includes a score line 26, 28 formed therein adjacent each of the opposed ends, 22, 24 thereby defining opposed flaps 30, 32. It will be recognized by those of skill in the art that the panel may be formed from any suitable material. For example, the panel may be formed from paper, paperboard, plastic, synthetic materials, natural materials, metal or any other suitable material.

Figure 4:
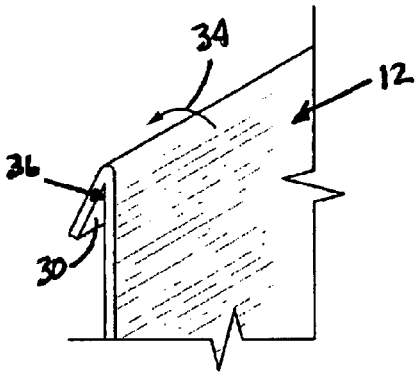
FIG. 4 is a detailed view of one end of the panel and a flap being moved to a folded position.

Referring to FIG. 4, each opposed flap 30 (32 not shown) is moved about the score line (not shown) as indicated by the arrow 34 to a position oriented approximately parallel with the panel 12. Preferably, the opposed flaps 30, 32 are both moved to a same side of the panel 12. A fold 36 is defined at an intersection of each opposed flap 30, 32 and the panel 12 generally along the score line.

Referring to FIG. 2, each of the first and second channels 14, 16 includes an elongated base 38, first and second opposed walls 40, 42 extending from offset edges 44, 46 of the elongated base 38 and a flange 48 extending from a free end 50 of one of the first and second walls 40, 42 in the direction of the other wall and the elongated base 38. In this embodiment of the present invention, the flange 48 extends from the free end 50 of the first wall 40. A free end 52 of the flange 48 is disposed proximate the other wall, 42 in this embodiment, in order to define an elongated opening (54 see FIG. 5) into the channel 14, 16. It will be recognized by those of skill in the art that the channels may be formed from any suitable material. For example, the channels may be formed from plastic, metal, composite, synthetic material, natural material or any other suitable material.

A device 18 has a proximate end 56 connected to the first channel 14 and a distal end 58 connected to a support such that the assembly 10 depends from the support. A safety device 20 loosely extends from the first channel to the second channel 16. The first channel 14 further includes a first mount 60 for engaging the device 18 and the safety device 20 which is disposed on the second wall 42 opposite the flange 48. The second channel 16 further includes a second mount 62 for engaging the safety device 20 which is disposed on the second wall 42 opposite the flange 48.

The device 18 and the safety device 20 are preferably constructed of multi-stranded wire. However, it will be recognized by those of skill in the art that any other suitable material may be substituted therefore to provide equivalent functionality. For example, string, rope, chain, cord or any other suitable material may be used.

In another embodiment of the present invention, the device 18, may be configured as a hangar 64 having a base plate 66 connected to one of the first and second walls 40, 42 opposite the flange 48 (the second wall 42 in this embodiment) and a ring 68 operatively connected to the base plate 66. It will be recognized by those of skill in the art that this embodiment of the present invention is particularly useful for hanging the display assembly 10 from a traditional picture or a wall hook. It is within the teaching of the present invention that the hanger may be formed from any suitable material. For example, the hanger may be formed from plastic, metal, composite, synthetic material, natural material or any other suitable material. Furthermore, the structural configuration may be altered within the teaching of the present invention to provide identical functionality without departing therefrom. For example, the base plate and ring may have alternative structural configurations dictated by the illegible application of the channels.

FIG. 2 illustrates one embodiment of the present invention wherein the first channel 14 and the second channel 16 are disposed in a first operative position such that each of the first and second channels 14, 16 is operatively connected to the panel 12 for displaying the indicia thereon. In order to connect the panel 12 to the first and second channels 14, 16, each opposed flap 30, 32 must be moved about the respective score line 26, 28, to a position oriented approximately parallel with the panel 12 for insertion through the elongated opening 54 in one of the first and second channels 14, 16.

Figure 5:
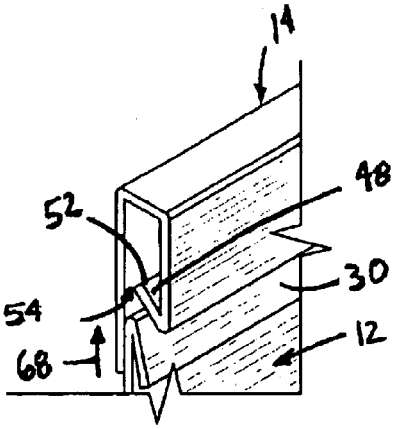
FIG. 5 is a detailed view of the panel and the folded flap presented for insertion into the elongated opening of a channel.

As shown in FIG. 5, the panel 12 is inserted through the elongated opening 54 in the direction of arrow 68. The elongated opening 54 is configured such that the flap 30 when disposed in a position oriented approximately parallel, the thickness of the folded panel 12 is slightly less than elongated opening 54 so that the folded panel 12 fits snugly therethrough.

Figure 6:
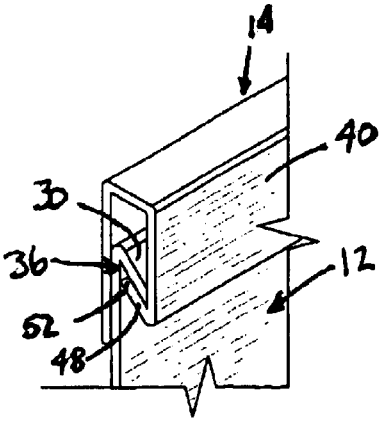
FIG. 6 is a detailed view of the panel connected to the channel.

When the free end 22, 24 of the respective flap 30, 32 is inserted beyond the free end 52 of the flange 48, the flap 30 is biased away from the approximate parallel orientation with the panel 12 as a result of the material of construction of the panel in order to thereby connect the panel 12 to the channel 14, see FIG. 6. The flap 30 remains disposed at an acute angle to the panel 12 as a result of contact with the first wall 40. As a result, the panel is locked in position with respect to the channel 14. The fold 36 engages the free end 52 of the flange 48.

In another embodiment of the present invention, a second operative position is defined when the first or second channel 14, 16 is disconnected from the channel such that the safety device 20 taughtly extends between the first and second channel 14, 16 in order to support the second channel 16 from falling.

While the preferred embodiment of the invention have been shown and described, it will be apparent to those skilled in the art that changes or modifications may be made therein without departing from the spirit of the invention, the scope of which is defined by the appended claims.

What is claimed is:

1. A display assembly comprising:

a panel for displaying indicia having opposing ends, each opposing end operatively connected to one of a first and a second channels;

the panel further having a score line formed therein adjacent each opposed end thereby defining opposed flaps;

the first and second channels each including an elongated base, first and second opposed walls extending from offset edges of the elongated base and a flange extending from a free end of one of the first and second walls in the direction of the other wall and the elongated base such that a free end of the flange is disposed proximate the other wall in order to define an elongated opening into the channel;

a device having a proximate end connected to the first channel and a distal end connected to a support such that the assembly depends from the support;

a safety device loosely extending from the first channel to the second channel; and wherein each opposed flap is moved about the score line to a position oriented approximately parallel with the panel for insertion through the elongated opening in one of the first and second channels such that when a free end of the flap is inserted beyond the free end of the flange the flap is biased away from the approximate parallel orientation with the panel thereby connecting the panel to the channel.

2. The display assembly as recited in claim 1, wherein the device and the safety device are constructed of wire.

3. The display assembly as recited in claim 1, wherein the opposed flaps are both moved to a same side of the panel.

4. The display assembly as recited in claim 1, wherein a fold is defined at an intersection of each opposed flap and the panel generally along the score line, said fold engages the free end of the flange.

5. The display assembly as recited in claim 1, wherein the first channel further includes a first mount for engaging the device and the safety device disposed on one of the first and second walls opposite the flange.

6. The display assembly as recited in claim 1, wherein the second channel further includes a second mount for engaging the safety device disposed on one of the first and second walls opposite the flange.

7. The display assembly as recited in claim 1, wherein the device is configured as a hangar having a base plate connected to one of the first and second walls opposite the flange and a ring operatively connected to the base plate.

8. A display assembly, comprising:

a first channel and a second channel disposed in a first operative position where each first and second channel is operatively connected to a panel for displaying indicia thereon;

the first and second channels each including an elongated base, first and second opposed walls extending from offset edges of the elongated base and a flange extending from a free end of one of the first and second walls in the direction of the other wall and the elongated base such that a free end of the flange is disposed proximate the other wall in order to define an elongated opening into the channel;

the panel including opposed ends and a score line formed therein adjacent each of the opposed ends to define opposed flaps which are moved about respective score lines in order to pass through the elongated opening to operatively connect the panel to the first and second channels;

a device having a proximate end connected to the first channel and a distal end connected to a support such that the assembly depends from the support;

a safety device loosely extending from the first channel to the second channel when the first and second channels are disposed in the first operative position;

wherein, a second operative position is defined when the first or second channel is disconnected from the panel such that the safety device tautly extends between the first and second channels in order to support the second channel.

9. The display assembly as recited in claim 8, wherein a fold is defined at an intersection of each opposed flap and the panel generally along the score line, said fold engages the free end of the flange.

10. The display assembly as recited in claim 8, wherein the opposed flaps are disposed at an acute angle to the panel when operatively connected to the first or second channels.

11. The display assembly as recited in claim 8, wherein the device and the safety device are configured as a fine wire.

12. The display assembly as recited in claim 8, wherein the opposed flaps are each moved to a same side of the panel.

13. The display assembly as recited in claim 8, wherein the first channel further includes a first mount for engaging the device and safety device disposed on one of the first and second walls opposite of the flange.

14. The display assembly as recited in claim 8, wherein the second channel further includes a second mount for engaging the safety device disposed on one of the first and second walls opposite the flange.

15. The display assembly as recited in claim 8, wherein the device is configured as a hanger having a base plate corrected to one of the first and second walls opposite the flange and a ring operatively connected to the base plate.

16. A display assembly comprising:

a panel for displaying indicia having opposing ends, each opposing end operatively connected to one of a first and a second channels;

the panel further having a score line formed therein adjacent each opposed end thereby defining opposed flaps;

the first and second channels each including an elongated base, first and second opposed walls extending from offset edges of the elongated base and a flange extending from a free end of one of the first and second walls in the direction of the other wall and the elongated base such that a free end of the flange is disposed proximate the other wall in order to define an elongated opening into the channel;

a device configured as a hanger having a proximate end configured as a base plate connected to the first channel and a distal end configured as a ring connected to a support such that the assembly depends from the support; and a safety device extending between the first channel and the second channel;

wherein each opposed flap is moved about the score line to a position oriented approximately parallel with the panel to define a fold at an intersection of the flap and the panel generally along the score line so that the panel may be inserted through the elongated opening in one of the first and second channels such that when a free end of the flap is inserted beyond the free end of the flange the flap is biased away from the approximate parallel orientation with the panel into contact with one of the first and second walls such that the flap remains folded whereby the panel is connected to the channel and the fold engages the free end of the flange.

17. The display assembly as recited in claim 16, wherein the opposed flaps are both moved to a same side of the panel.

18. The display assembly as recited in claim 16, wherein the base plate is connected to one of the first and second walls opposite the flange.

* * * * *